US005515066A

United States Patent [19]

Kim et al.

[11] Patent Number: 5,515,066

[45] Date of Patent: May 7, 1996

[54] PHOTON-TRIGGERED RF RADIATOR USING BULK TYPE SWITCHING

[75] Inventors: Anderson H. Kim, Toms River; Leo D. Didomenico, Spotswood, both of N.J.

[73] Assignee: The United States of America as represented by the Secretary of the Army, Washington, D.C.

[21] Appl. No.: 340,917

[22] Filed: Nov. 17, 1994

Related U.S. Application Data

[63] Continuation-in-part of Ser. No. 109,541, Aug. 19, 1993, abandoned.

[51] Int. Cl.[6] ..... H01Q 1/36

[52] U.S. Cl. ..... 343/895

[58] Field of Search ..... 343/895; 250/214.1; H01Q 1/36, 9/27

[56] References Cited

U.S. PATENT DOCUMENTS

| | | | |
|---|---|---|---|
| 3,241,148 | 3/1966 | Lechtreck | 343/895 |
| 3,956,752 | 5/1976 | Phelan et al. | 343/895 |
| 4,243,993 | 1/1981 | Lamberty et al. | 343/895 |
| 4,319,248 | 3/1982 | Flam | 343/895 X |
| 5,028,971 | 7/1991 | Kim et al. | 357/30 |
| 5,177,486 | 1/1993 | Kim et al. | 342/21 |
| 5,227,621 | 7/1993 | Kim et al. | 250/214.1 |
| 5,283,584 | 2/1994 | Kim et al. | 342/21 |
| 5,351,063 | 9/1994 | Kim et al. | 343/895 |

FOREIGN PATENT DOCUMENTS

| | | | |
|---|---|---|---|
| 5075331 | 3/1992 | Japan | 343/895 |

*Primary Examiner*—Donald T. Hajec
*Assistant Examiner*—Steven Wigmore
*Attorney, Agent, or Firm*—Michael Zelenka; James A. Digiorgio

[57] ABSTRACT

A photon triggered RF radiator that is composed of a photoconductive substrate having a ground plane electrode on its bottom surface and a top surface electrode having separate sections to perform energy storage and energy radiation functions. The energy storage section has a bulk-type photoconductive switch position therein such that any energy stored in the energy storage section of the top surface electrode is instantaneously discharged through the substrate to the ground plane, thus causing a pulse of nanosecond pulsewidth dimension to radiate from the energy radiation section of the top surface electrode.

4 Claims, 2 Drawing Sheets

PHOTON-TRIGGERED RF RADIATOR USING BULK TYPE SWITCHING

GOVERNMENT INTEREST

The invention described herein may be manufactured, used, and licensed by or for the Government of the United States of America for governmental services without the payment to us of any royalty thereon.

NOTICE OF CONTINUATION

This application is a continuation-in-part of application Ser. No. 08/109,541, entitled "Photon Triggered Ultra-Wideband Radiator with Charged Reservoir," by inventors Anderson H. Kim and Leo D. DiDomenico, Attorney Docket No. CECOM 4804, filed Aug. 19, 1993, now abandoned.

NOTICE OF RELATED DISCLOSURES

The invention described herein is related to the applicants' co-pending application Ser. No. 08/121,656, entitled "Monolithic Photoconductive Spiral Antenna Driven By Quasi-Radial Line," filed Sep. 14, 1993, now abandoned, and U.S. Pat. No. 5,351,063 entitled "Ultra-Wideband High Power Photon Triggered Frequency Independent Radiator With Equiangular Spiral Antenna, issued to Kim et al. on 27 Sep. 1994.

FIELD OF THE INVENTION

This invention relates generally to the field of impulse driven wideband antennas and more particularly to photon triggered ultra-wideband radiators for use in impulse radar apparatus, active electromagnetic signal jammers, and relatively high power microwave radiating systems.

BACKGROUND OF THE INVENTION

In recent years there has been active research in the area of nanosecond-type pulse generation. Such research has produced devices that utilize high power photoconductive solid state switches coupled to energy storage devices. In order for such a device to produce a nanosecond-type pulse, its photoconductive switch must have the ability to transition from a high resistivity state to a conductive state in a sub-nanosecond time interval. One such switch, disclosed in U.S. Pat. No. 5,028,971, issued to Anderson H. Kim et al on Jul. 2, 1991, entitled, "High Power Photoconductor Bulk GaAs Switch" is incorporated herein by reference.

This GaAs switch is comprised of two, mutually opposite, gridded electrodes separated by a GaAs substrate capable of electrical energy storage. The stored energy can be photoconductively discharged when it receives laser light. More specifically, when the laser light is applied to the semiconductor material, electron hole pairs are generated in the substrate, thus causing the electrical resistance of the semiconductor material to instantaneously decrease. This instantaneous resistance change causes the stored energy to convert into discharge current and flow through an output circuit such that an RF pulse is radiated in a direction perpendicular to the substrate.

It is widely recognized that the shorter the RF radiator's pulsewidth becomes, the wider its radiation bandwidth will be. Hence, the faster the radiated pulse's rise time becomes, the wider the radiation bandwidth will be. Consequently, it has become very desirable for those skilled in the art to construct devices capable of generating pulses having faster and faster rise-times so that the radiation bandwidth can be extended further and further.

The critical element in generating such fast rise time, high voltage pulses is the energy storage device itself. Heretofore, there are two general energy storage techniques used to generate faster rise-time, high power pulses.

The first technique is to create a device that utilizes the recombination property of semiconductor material. It has been determined, however, that such semiconductor materials exhibit a slow switch recovery time at high voltages. The long recovery time has been attributed to both the switch lock-on phenomena and the substantially long recombination time attributable to gallium arsenide. Hence, devices utilizing this storage technique are not desirable for the many wideband applications that require such high power pulses.

The second technique is to utilize an energy storage element comprised of either a short section of transmission line or a capacitor that can be photoconductively triggered to instantaneously discharge all, or substantially all, of its stored energy to a load. As with the aforementioned technique, the extended recovery time inherent in a device utilizing such a photoconductive switch prevents this device from producing extended wideband radiation.

A major breakthrough in the generation of narrow pulses, however, was disclosed in the inventors U.S. Pat No. 5,227,621 entitled "Ultra-Wideband High Power Photon Triggered Frequency Independent Radiator," issued to Kim et al. Jul. 13, 1993 and incorporated herein by reference. As disclosed, this frequency-independent radiator combines energy storage and antenna radiating functions into one structure to create an ultra-wideband frequency radiator capable of generating pulses with a range of frequency components from hundreds of megahertz to several gigahertz. Basically, this radiator utilizes two identical quasi-radial transmission line structures to store electric energy while it simultaneously implements photoconductive switching to trigger the instantaneous discharge of the stored energy to generate the desired ultra-wideband RF radiation.

Such an energy storage device comprises a dielectric storage medium, two quasi-radially shaped, metalized electrodes mounted opposite one another on the top surface of the dielectric storage medium, and a metalized electrode mounted on the bottom surface of the dielectric medium. The two quasi-radial shaped electrodes are connected to the bottom electrode via a photoconductive switch centrally located on the dielectric. When the switch is activated by laser radiation, the stored energy discharges through a predetermined load such that a sub-nanosecond type pulse is generated.

Those skilled in the art have recognized that the shape and overall geometry of the device directly affects the width of the discharged pulse, and thus its bandwidth. Specifically, the shape of the electrodes, the position of the energy storage elements, and the position of the photoconductive switches, directly affect the charging and discharging characteristics of the stored energy.

It has also been recognized that the gap distance between the electrodes directly affects the bandwidth of the radiated pulse. The narrower the gap the greater the radiated bandwidth. If the gap is made too small, however, device flashover, and thus device breakdown, may occur. Consequently, device efficiency is directly limited by the geometry of the storage element.

A radiator incorporating a storage element with an innovative geometry to achieve an even greater bandwidth than the prior art was disclosed in the inventor's co-pending application entitled "Ultra-wideband High Power Photon Triggered Frequency Independent Radiator With Equiangular Spiral Antenna, " Ser. No 08/064,525, and incorporated herein by reference. This device utilized an equiangular spiral antenna electrode (in place of the quasi-radial transmission line disclosed above) positioned on the surface of a photoconductive semiconductor substrate. The spiral antenna electrode was positioned such that it could store high power electrical energy to be instantaneously discharged upon photon triggering. Consequently, the energy storage and energy radiation functions are performed in the same section of the device (i.e. spiral antenna). The result is a device that radiates RF energy at a much wider bandwidth than previously disclosed without compromising the radiated field strength.

Although RF generators utilizing such a device geometry can radiate energy having increased bandwidth and improved performance over existing devices, those skilled in the art still desire and recognize the need for Rf generators utilizing new and innovative geometric shapes and schemes that provide for even greater device performance and efficiency while not adding to the device's overall size or cost.

SUMMARY OF THE INVENTION

Accordingly, this invention provides a photon triggered ultra-wideband RF radiator having enhanced performance, improved operating efficiency, and thus improved overall effectiveness over those previously disclosed. To attain this, the present invention provides an RF radiator having a photoconductive substrate with a top surface electrode that provides both energy storage and energy radiation functions but in geometrically separate locations of the top surface of a photoconductive substrate. As a result, the gap between the energy storage and energy radiation sections is minimized, thus minimizing the rise time of the generated pulse so that the structure has improved performance over the prior art.

In general, the photoconductive substrate has a top surface electrode that covers both the outer annular region and the center portion of its top surface. A ground plane electrode is positioned on the bottom surface of the substrate, but only covering the outer annular region of that bottom surface. A bulk-type photoconductive switch is formed within the electrode in the outer annular region of the top surface electrode by etching away a portion of that top surface electrode directly above the ground plane electrode on the bottom surface to expose the photoconductive substrate through the top surface electrode. As a result, the top surface electrode can be electrically shorted to the ground plane electrode by applying a predetermined light energy to the bulk-type photoconductive switch.

Consequently, upon triggering the bulk-type photoconductive switch, energy stored on the top surface electrode discharges through the substrate to the ground plane causing a narrow output pulse of nanosecond pulsewidth dimension to radiated from center portion of the top surface electrode. This essentially separates the top surface electrode into two functional areas; the energy storage and discharge region in the outer annular region of the substrate and the energy radiation region in the center portion of the substrate. This geometric decoupling of the energy storage and radiator functions increases the radiation bandwidth, and thus enables the device to radiate more like an ideal frequency independent antenna.

Although the absence of ground plane electrode beneath the energy radiation portion of the top surface electrode may cause a substantial decrease in the storage capability of the RF radiator structure, the overall radiation efficiency is increased due to the proximity of, yet separation of, the energy storage region and energy radiation region. Consequently, the RF radiator of the present invention provides for a wider bandwidth than that achieved by devices having both functions combined into the same section of the device, as in the prior art.

These and other features of the invention are described in more complete detail in the following description of the preferred embodiment when taken with the drawings. The scope of the invention, however, is limited only by the claims appended hereto.

DESCRIPTION OF THE PREFERRED EMBODIMENT

Figure 1:
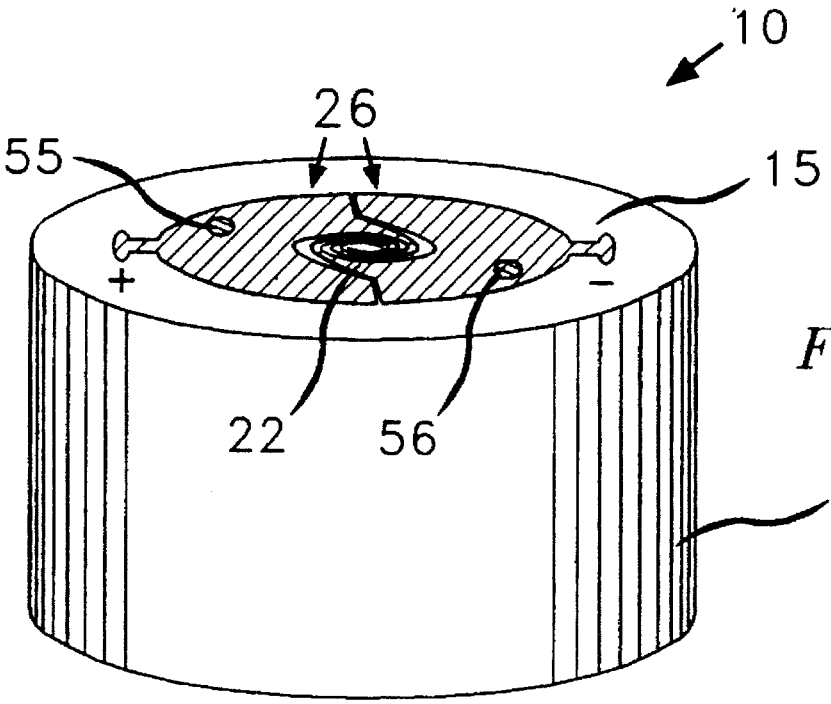
FIG. 1 is a side pictorial view of the preferred embodiment of the invention.
Figure 2:
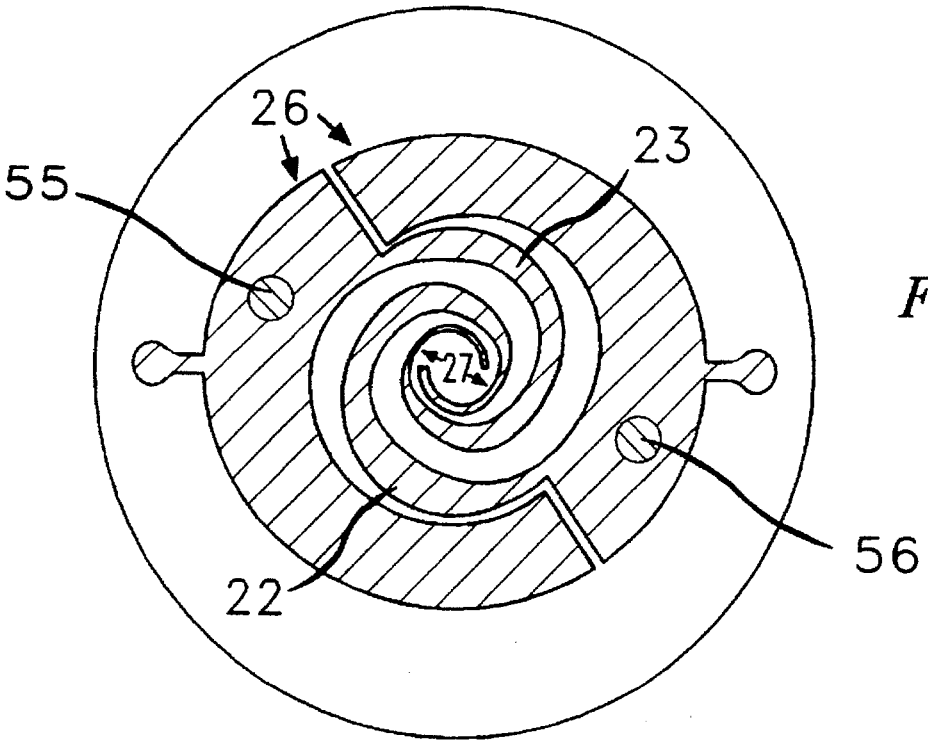
FIG. 2 is a top pictorial view of the upper surface electrode of the preferred embodiment in FIG. 1.

Referring now to the drawings there is shown in FIG.'s 1 and 2 side pictorial view and top view, respectively, of preferred embodiment 10. As shown, top surface 15 of photoconductive dielectric substrate 20 has top surface electrode 26 composed of inner spiral antenna arms or spiral arms 22 and 23, and outer electrode charging pads or charging pads 53 and 54. Charging pads 53 and 54 each contain a bulk-type photoconductive switch 55 and 56, respectively. Spiral arms 22 and 23 are separated by predetermined spiral gap 27 whose size directly affects the radiation bandwidth of device 10. Basically, the narrower the gap 27, the greater the radiation bandwidth.

Figure 3:
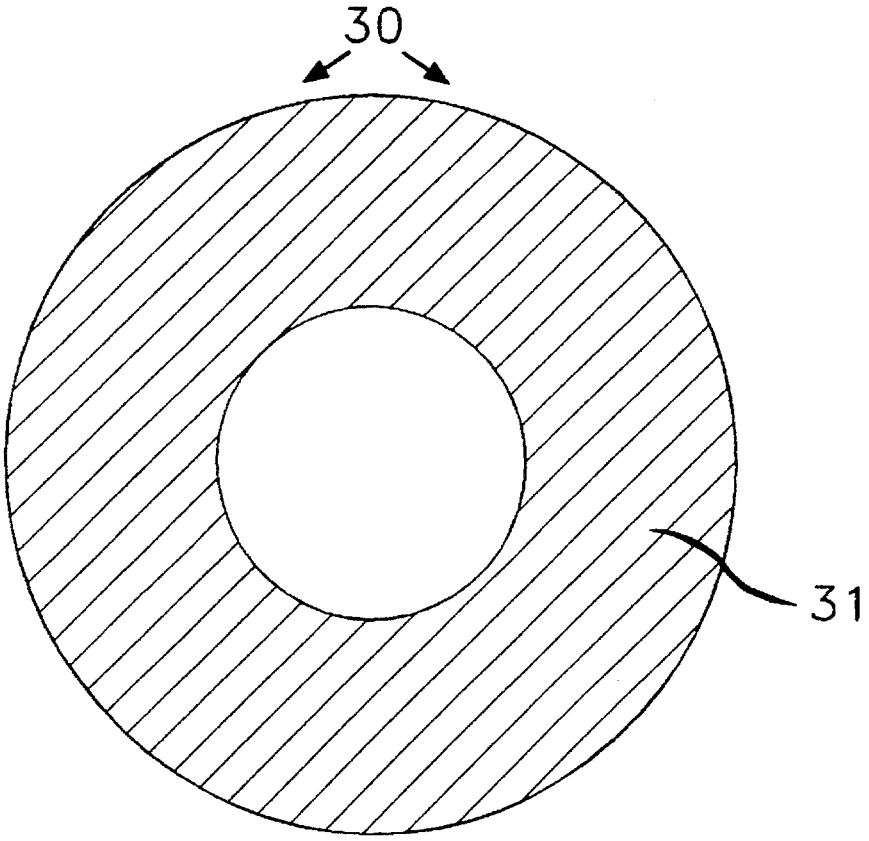
FIG. 3 is a bottom pictorial view of the annular ground plane of the preferred embodiment in FIG. 1.

In FIG. 3, there is shown bottom surface 30 having annular ground plane electrode or ground plane 31 positioned thereon directly beneath charging pads 53 and 54 such that spiral arms 22 and 23 have no portion of ground plane 31 directly beneath them. This configuration allows electrical energy to be stored on top surface electrode 26 such that upon the application of a predetermined type of light energy on bulk switches 55 and 56, the stored energy instantaneously discharges through substrate 20 to ground plane electrode 31. In effect, this instantaneous discharge produces a narrow pulse of nanosecond pulsewidth dimension to radiate from spiral arms 22 and 23 in the center region of the top surface of substrate 20. As a result, the energy storage and energy radiation functions of embodiment 10 are in separate positions on top surface electrode 26.

This geometric decoupling of the energy storage and radiator functions increases the radiation bandwidth, and thus enables the device to radiate more like an ideal frequency independent antenna. Although the absence of ground plane electrode beneath the energy radiation portion of the top surface electrode may cause a substantial decrease in the storage capability of the RF radiator structure, the overall radiation efficiency is increased due to the proximity of, yet separation of, the energy storage region and energy radiation region. Consequently, the RF radiator of the present invention provides for a wider bandwidth than that achieved by devices having both functions combined into the same section of the device, as in the prior art.

Operating the device involves alternately charging top surface electrode 26 to voltages of different polarity and equal magnitude (+Vo and −Vo) relative to the ground plane, and then photoconductively triggering their discharge by directing a pulsed beam of laser light, having the correct frequency to cause conduction, at bulk switches 55 and 56. This immediately electrically shorts charging pads 53 and 54 on top surface electrode 26 to ground plane 31, thus causing an instantaneous current to flow through spiral arms 22 and 23 in opposite directions which, in turn, causes electromagnetic energy of nanosecond pulsewidth direction to radiate into free space.

What is claimed is:

1. An ultra-wideband RF radiator, comprising:

a photoconductive dielectric substrate having an upper and a lower surface, each said upper and lower surface having an outer annular region and a center region adjacent thereto;

a ground plane electrode positioned on said lower surface of said photoconductive dielectric substrate substantially toward said outer annular region of said lower surface; and a top surface electrode positioned on said upper surface of said photoconductive substrate, said top surface electrode having an energy storage region and an energy radiation region, said energy storage region positioned substantially toward said outer annular region of said top surface directly above said ground plane electrode, said energy radiation region positioned substantially toward said center of said top surface such that no ground plane lies directly beneath said energy radiation region;

said energy storage region of said top surface electrode having a recessed region exposing a predetermined portion of said upper surface of said photoconductive substrate to form a bulk photoconductive switch in said recessed region so that said photoconductive switch electrically shorts said energy storage region of said top surface electrode to said ground plane electrode upon the application of a predetermined type of light energy such that a pulse of nanosecond pulsewidth dimension is radiated from said energy radiation region of said top surface electrode.

2. The ultra wideband RF radiator of claim 1 wherein said top surface electrode is comprised of a plurality of metallic arms.

3. The ultra wideband RF radiator of claim 2 wherein said plurality of metallic arms are have a spiral antenna portion in said energy radiation region and a charging pad portion in said energy storage region.

4. The ultra wideband RF radiator of claim 1 wherein said photoconductive dielectric substrate is comprised of GaAs.

* * * * *